US005422801A

United States Patent [19]

Sangalli, Jr.

[11] Patent Number: 5,422,801

[45] Date of Patent: Jun. 6, 1995

[54] CHRISTMAS TREE LIGHT RING ARRANGEMENT

[76] Inventor: Joseph F. Sangalli, Jr., 2203 Locust, Texarkana, Ark. 75502

[21] Appl. No.: 226,832

[22] Filed: Apr. 13, 1994

[51] Int. Cl.[6] ..... F21P 1/02

[52] U.S. Cl. ..... 362/252; 362/123; 362/226; 362/808

[58] Field of Search ..... 362/122, 123, 249, 252, 362/806, 807, 808, 226, 250

[56] References Cited

U.S. PATENT DOCUMENTS

| | | | |
|---|---|---|---|
| D. 263,938 | 4/1982 | Gordon | D11/118 |
| 1,429,408 | 9/1922 | Cole | 362/806 |
| 1,847,687 | 3/1932 | Biertuempfel | 362/806 |
| 1,900,807 | 3/1933 | Fegley et al. | 362/249 |
| 2,047,045 | 7/1936 | Veenboer | 362/249 |
| 2,230,900 | 2/1941 | Neitzke | 362/806 |
| 3,003,056 | 10/1961 | Resch | 362/807 |
| 3,571,586 | 3/1971 | Duckworth | 362/123 |
| 3,655,495 | 4/1972 | Carrell | 362/121 |
| 3,752,407 | 8/1973 | Baugh et al. | 362/123 |
| 4,172,913 | 10/1979 | Ballah et al. | 428/9 |
| 4,516,193 | 5/1985 | Murphy | 362/123 |
| 4,956,757 | 9/1990 | Wang | 362/252 |
| 5,150,963 | 9/1992 | Hill | 362/123 |

*Primary Examiner*—Ira S. Lazarus
*Assistant Examiner*—Alan B. Cariaso

[57] ABSTRACT

A plurality of light rings are arranged for mounting about a Christmas tree trunk, wherein each of the light rings includes rigid first and second semi-cylindrical housings having cooperating latch structure to secure the semi-cylindrical housings together about the tree trunk. The first housing includes a first semi-cylindrical annular array of lights mounted to a top wall thereof, with the second housing having a second semi-cylindrical annular array of lights mounted to its top wall, with the first and second housing outer walls including first and second outer annular arrays of lights projecting therefrom. In this manner, illumination within the tree is provided.

7 Claims, 3 Drawing Sheets

CHRISTMAS TREE LIGHT RING ARRANGEMENT

BACKGROUND OF THE INVENTION

1. Field of the Invention

The field of the invention relates to Christmas tree light apparatus, and more particularly pertains to a new Christmas tree light ring arrangement wherein the same is arranged to mount annular arrays of lights about and adjacent the tree trunk of an associated Christmas tree.

2. Description of the Prior Art

To provide for inner lighting of a Christmas tree is at contrast with the prior art, wherein typically lights are mounted relative to the outer peripheral portions of the limbs of the associated Christmas tree. A prior art patent such as indicated by the U.S. Pat. No. 4,516,393 sets forth a plurality of strap members arranged for mounting about the Christmas tree trunk, wherein the strap members provide electrical outlets for Christmas tree lights to be mounted about the Christmas tree limbs and outer peripheral portions of the tree.

The instant invention attempts to overcomes deficiencies of the prior art through the positioning of lights adjacent the Christmas tree trunk to provide for additional lighting and visual effect relative to a Christmas tree structure.

SUMMARY OF THE INVENTION

In view of the disadvantages inherent in the known types of Christmas tree light apparatus now present in the prior art, the present invention provides a Christmas tree light ring arrangement wherein the same provides for a light ring member to be mounted about the tree trunk of an associated Christmas tree to provide for enhanced lighting relative to the Christmas tree in use.

To attain this, the present invention provides a plurality of light rings which are arranged for mounting about a Christmas tree trunk, wherein each of the light rings includes rigid first and second semi-cylindrical housings having cooperating latch structure to secure the semi-cylindrical housings together about the tree trunk. The first housing includes a first semi-cylindrical annular array of lights mounted to a top wall thereof, with the second housing having a second semi-cylindrical annular array of lights mounted to its top wall, with the first and second housing outer walls including first and second outer annular arrays of lights projecting therefrom. In this manner, illumination within the tree is provided.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is an object of the present invention to provide a new Christmas tree light ring arrangement which may be easily and efficiently manufactured and marketed.

It is a further object of the present invention to provide a new Christmas tree light ring arrangement which is of a durable and reliable construction.

An even further object of the present invention is to provide a new Christmas tree light ring arrangement which is susceptible of a low cost of manufacture with regard to both materials and labor, and which accordingly is then susceptible of low prices of sale to the consuming public, thereby making such Christmas tree light ring arrangements economically available to the buying public.

Still yet another object of the present invention is to provide a new Christmas tree light ring arrangement which provides in the apparatuses and methods of the prior art some of the advantages thereof, while simultaneously overcoming some of the disadvantages normally associated therewith.

Even still yet another object of the present invention is to provide a new Christmas tree light ring arrangement which includes a plurality of light rings arranged for mounting about a Christmas tree trunk, wherein each of the light rings includes rigid first and second semi-cylindrical housings having cooperating latch structure to secure the semi-cylindrical housings together about the tree trunk, with the first housing including a first semi-cylindrical annular array of lights mounted to a top wall thereof, and the second housing having a second semi-cylindrical annular array of lights mounted to its top wall, with the first and second housing outer walls including first and second outer annular arrays of lights projecting therefrom.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
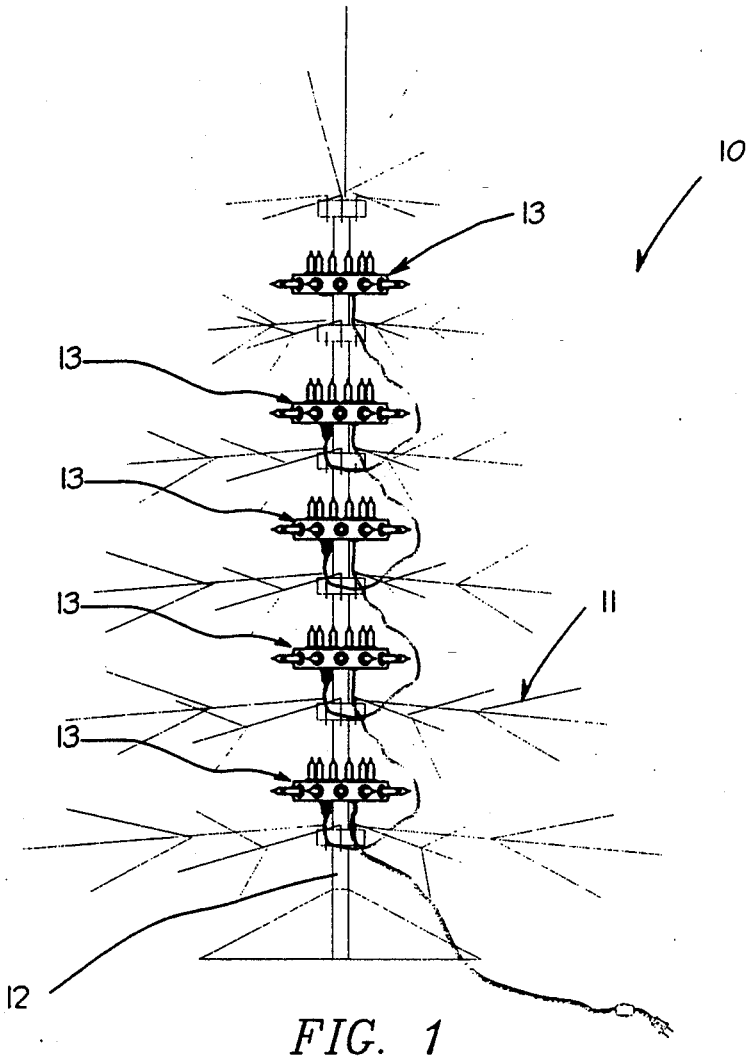
FIG. 1 is an orthographic view of the invention mounted to an associated Christmas tree.
Figure 2:
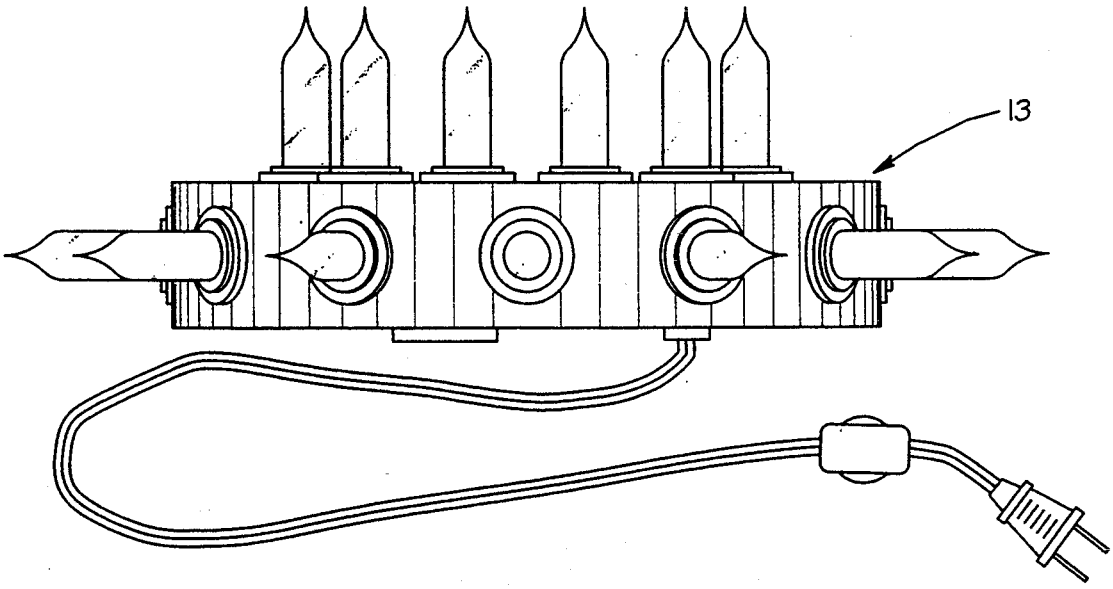
FIG. 2 is an enlarged orthographic view of an individual lighting member.

With reference now to the drawings, and in particular to FIGS. 1–6 thereof, a new Christmas tree light ring arrangement embodying the principles and concepts of the present invention and generally designated by the reference numeral 10 will be described.

Figure 3:
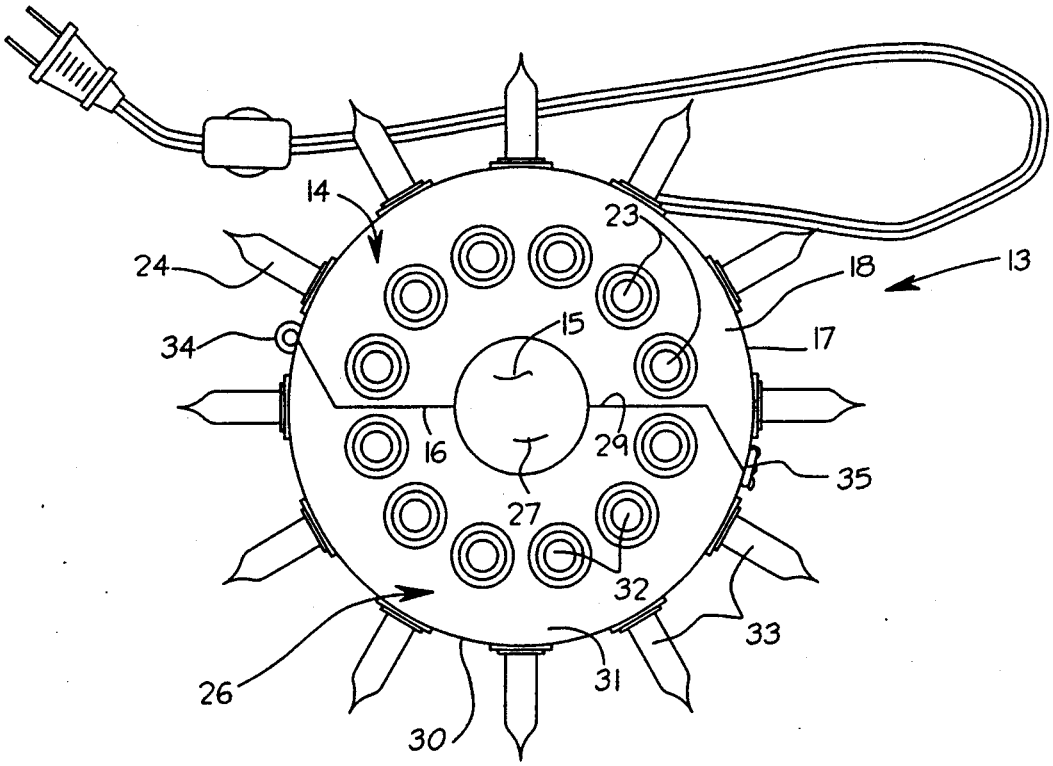
FIG. 3 is an orthographic top view of the lighting ring member.

More specifically, the Christmas tree light ring arrangement 10 of the instant invention is arranged for mounting about a Christmas tree 11 having a trunk 12, with the invention comprising a plurality of lighting members 13 each of a generally cylindrical configuration arranged for intercommunication relative to one another to effect illumination about the Christmas tree, and more specifically in adjacency to the trunk 12. As illustrated in FIG. 3, each of the lighting members 13 includes cooperative first and second semi-cylindrical housings 14 and 26, having respective first and second semi-cylindrical bores 15 and 27 arranged for cooperation relative to one another, such that the .first and second bores receive the tree trunk 12 therewithin when the lighting member 13 is in an opened or second configuration, and capture the trunk when subsequently positioned in a closed or first position. A hinge 34 mounted to the first and second housing outer walls 17 and 30 permits pivoting of the first and second housings relative to one another and their subsequent securement by a latch 35 mounted to the first housing cooperative with a latch lug 35a mounted to the second housing.

Figure 4:
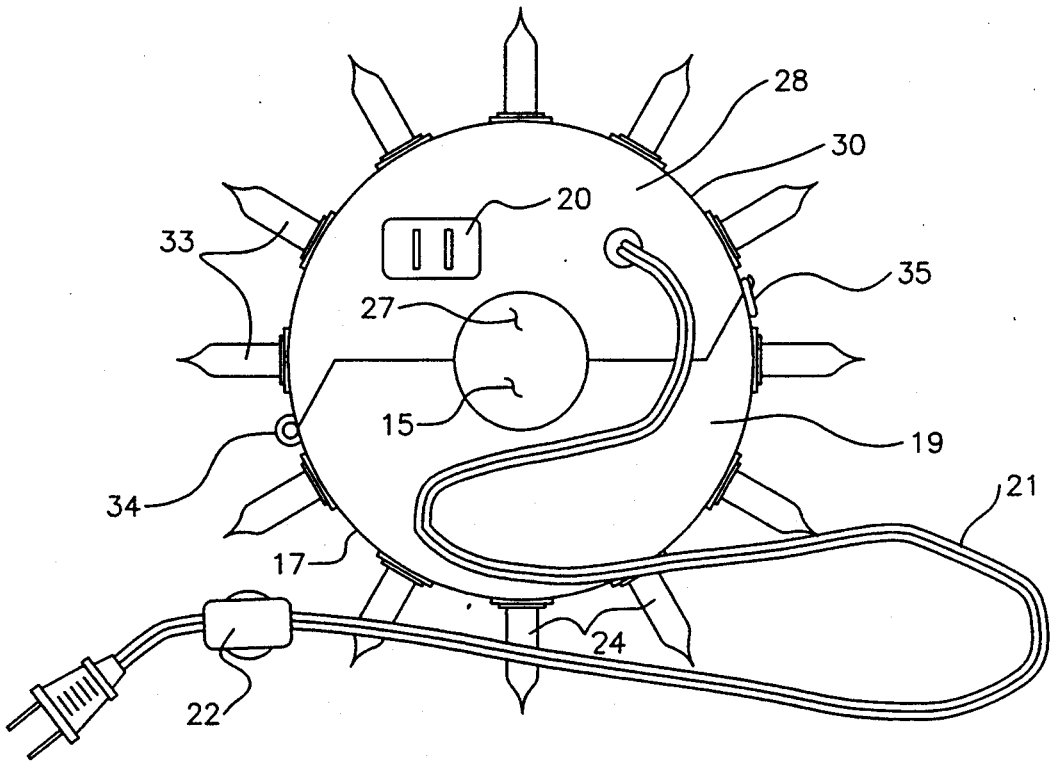
FIG. 4 is an orthographic bottom view of the lighting ring member.
Figure 5:
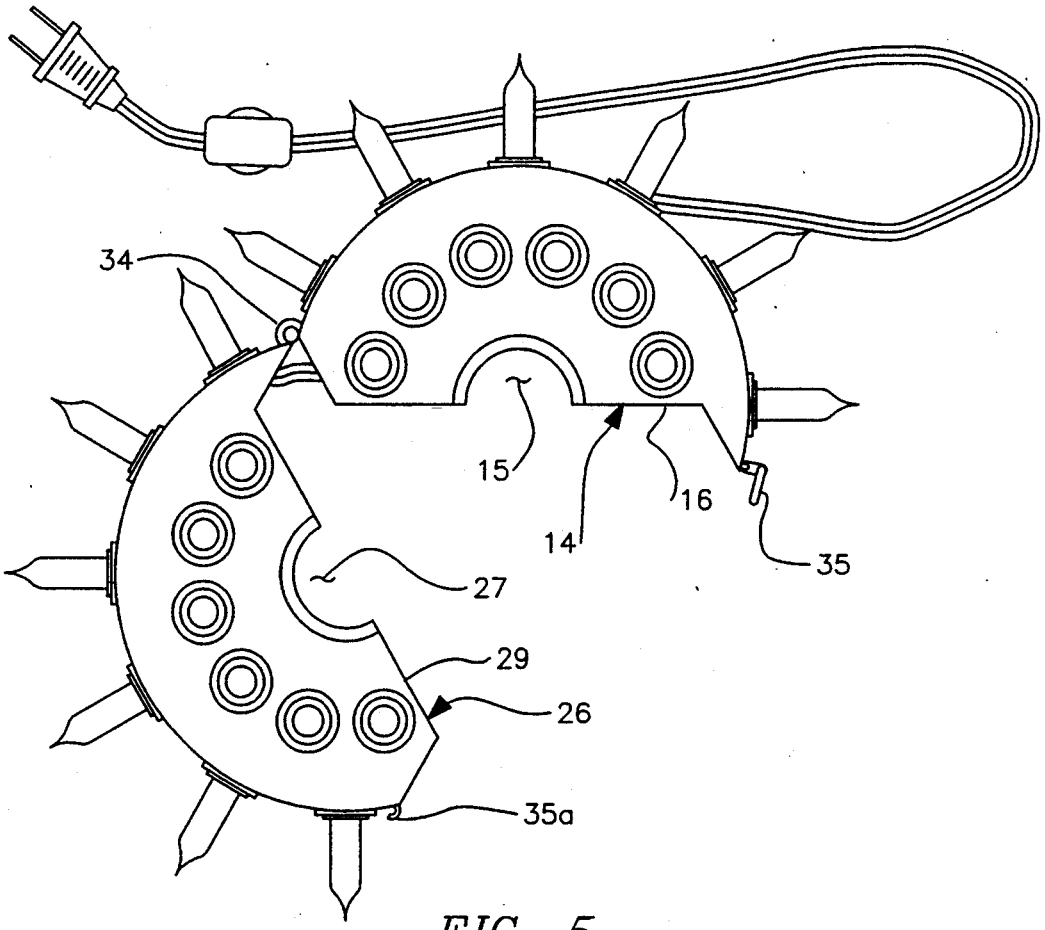
FIG. 5 is an orthographic top view of the lighting ring in an opened configuration.
Figure 6:
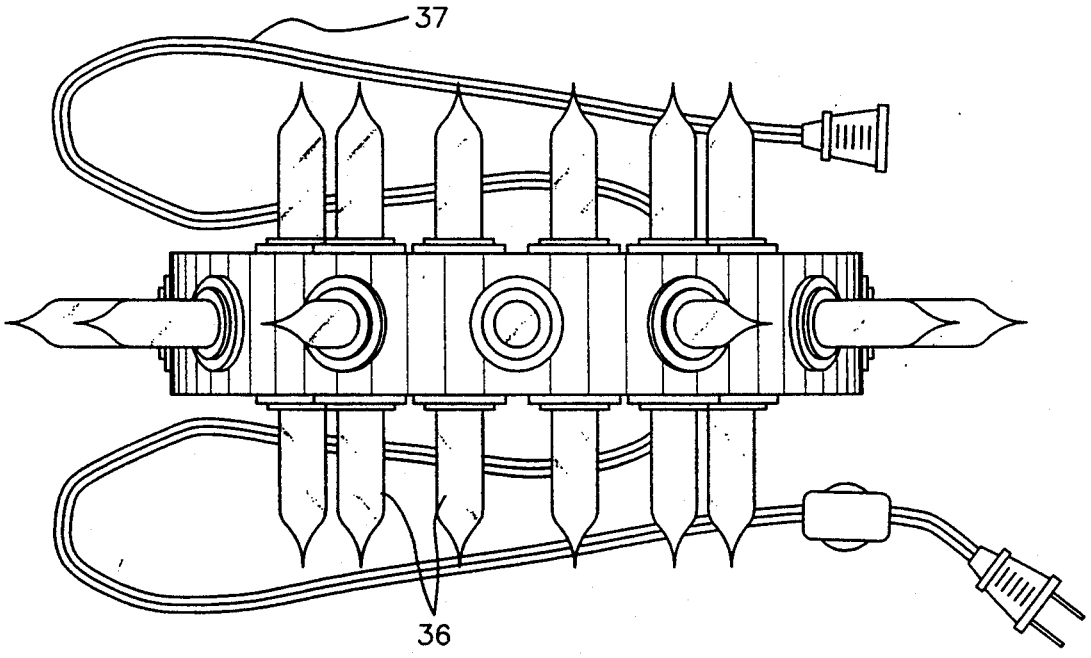
FIG. 6 is an orthographic side view of the lighting ring member to include additional bottom wall lighting.

As shown in FIGS. 3–5, the first housing 14 includes a first housing end wall 16 arranged to engage in a contiguous and coextensive manner the second housing end wall 29. A first housing semi-cylindrical outer wall 17 is arranged in a spaced, concentric relationship relative to the first bore 15, as is a second housing semi-cylindrical outer wall 30 relative to its second bore 27. A first housing top wall 18 is provided relative to a first housing bottom wall 19, with a second housing top wall 31 arranged relative to a second housing bottom wall 28. The second housing bottom wall 28 is arranged to be provided with an outlet means or electrical outlet connector 20 and an electrical supply line 21 directed into the lighting member 13, such that the electrical outlet connector 20, or alternatively an extension cord 37 as illustrated in FIG. 6, permits intercommunication of the plurality of lighting members 13 relative to one another, as indicated in FIG. 1. It should be noted that the first housing top wall 18 and the second housing top wall 31 are coplanar, as are the first housing bottom wall 19 and the second housing bottom wall 28.

To provide for illumination, the first housing top wall is formed with a first semi-cylindrical array of lights 23, with the second housing top wall 31 being provided with a second semi-cylindrical annular array of lights 32 projecting therefrom. The first housing outer wall 17 is similarly provided with a first outer wall annular array of lights 24 in a semi-circular configuration and the second housing outer wall 30 has a second outer wall annular array of lights 33 projecting therefrom. If desired, bottom wall lights 36, as indicated in FIG. 6, may be provided relative to the first and second housing bottom walls 19 and 28. The lights 23, 24, 32, 33, and 36 preferably comprise light bulbs fixedly secured to the respective wall 18, 31, 17, 30, and 19 or 28 to which they are attached so as to project substantially orthogonally therefrom.

As to the manner of usage and operation of the instant invention, the same should be apparent from the above disclosure, and accordingly no further discussion relative to the manner of usage and operation of the instant invention shall be provided.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as encompass all such modifications as well as all relationships equivalent to those illustrated in the drawings and described in the specification.

Finally, it will be appreciated that the purpose of the Abstract provided at the beginning of this specification is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by LETTERS PATENT of the United States is as follows:

1. A Christmas tree light ring comprising:

a first semi-cylindrical housing, with the first housing having a first housing end wall, the first housing end wall including a first semi-cylindrical bore, the first housing further having a first housing semi-cylindrical outer wall, with the first housing outer wall having a first semi-annular array of light bulbs fixedly secured to and projecting substantially orthogonally therefrom, the first housing still further having a first housing top wall, and the first housing top wall having a semi-cylindrical annular array of light bulbs fixedly secured to and projecting substantially orthogonally therefrom, the first housing still yet further having a first housing bottom wall;

a second semi-cylindrical housing pivotally mounted to the first housing, the second housing having a second housing end wall, the second housing end wall including a second semi-cylindrical bore, with the first semi-cylindrical bore and the second semi-cylindrical bore being aligned when the first housing and the second housing are arranged in a first position with the first housing end wall and the second housing end wall in contiguous communication relative to one another, and the first semi-cylindrical bore and the second semi-cylindrical bore being spaced relative to one another when the first housing end wall and the second housing end wall are spaced relative to one another in a second position, the second housing further having a second housing semi-cylindrical outer wall, and the second housing outer wall having a second semi-annular array of light bulbs fixedly secured to and projecting substantially orthogonally therefrom, the second housing still further having a second housing top wall coplanar with the first housing top wall, and the second housing top wall having a second semi-cylindrical annular array of light bulbs fixedly secured to and projecting substantially orthogonally therefrom, the second housing still yet further having a second housing bottom wall coplanar with the first housing bottom wall;

and, an electrical supply line directed into the second housing bottom wall in electrical communication with the first annular array of light bulbs, the second annular array of light bulbs, the first semi-cylindrical array of light bulbs, and the second semi-cylindrical annular array of light bulbs.

2. A Christmas tree light ring as recited in claim 1, and further comprising:

a hinge mounted to the first housing outer wall and the second housing outer wall at a first end of the first housing end wall and the second housing end wall;

a latch member mounted to the first housing outer wall at a second end of the first housing end wall;

and, a latch lug mounted to the second housing outer wall cooperative with the latch member, with the latch lug mounted to a second end of the second housing end 3. A Christmas tree light ring as recited in claim 2, and further comprising an outlet means for electrically connecting another light ring thereto.

4. A Christmas tree light ring as recited in claim 3, wherein said outlet means comprises an electrical outlet connector.

5. A Christmas tree light ring as recited in claim 3, wherein said outlet means comprises an extension cord.

6. A Christmas tree light ring as recited in claim 1, and further comprising a first annular array of bottom wall light bulbs fixedly secured to and projecting substantially orthogonally from the first housing bottom wall; and a second annular array of bottom wall light bulbs fixedly secured to and projecting substantially orthogonally from the second housing bottom wall, the bottom wall light bulbs being electrically connected to the electrical supply line.

7. A method of illuminating a Christmas tree having a tree trunk, said method comprising the steps of:

providing a light ring comprising a first semi-cylindrical housing, with the first housing having a first housing end wall, the first housing end wall including a first semi-cylindrical bore, the first housing further having a first housing semi-cylindrical outer wall, with the first housing outer wall having first semi-annular array of light bulbs fixedly secured to and projecting substantially orthogonally therefrom, the first housing still further having a first housing top wall, and the first housing top wall having a semi-cylindrical annular array of light bulbs fixedly secured to and projecting substantially orthogonally therefrom, the first housing still yet further having a first housing bottom wall; a second semi-cylindrical housing pivotally mounted to the first housing, the second housing having a second housing end wall, the second housing end wall including a second semi-cylindrical bore, with the first semi-cylindrical bore and the second semi-cylindrical bore being aligned when the first housing and the second housing are arranged in a first position with the first housing end wall and the second housing end wall in contiguous communication relative to one another, and the first semi-cylindrical bore and the second semi-cylindrical bore being spaced relative to one another when the first housing end wall and the second housing end wall are spaced relative to one another in a second position, the second housing further having a second housing semi-cylindrical outer wall, and the second housing outer wall having a second semi-annular array of light bulbs fixedly secured to and projecting substantially orthogonally therefrom, the second housing still further having a second housing top wall coplanar with the first housing top wall, and the second top wall having a second semi-cylindrical annular array of light bulbs fixedly secured to and projecting substantially orthogonally therefrom, the second housing still yet further having a second housing bottom wall coplanar with the first housing bottom wall; and, an electrical supply line directed into the second housing bottom wall in electrical communication with the first annular array of light bulbs, the second annular array of light bulbs, the first semi-cylindrical array of light bulbs, and the second semi-cylindrical annular array of light bulbs;

positioning the first and second housings about said trunk of said tree such that said first semi-annular array of light bulbs projects substantially orthogonally relative to a longitudinal axis of said tree trunk, said first semi-cylindrical annular array of light bulbs projects substantially parallel to said longitudinal axis of said tree trunk, said second semi-annular array of light bulbs projects substantially orthogonally relative to a longitudinal axis of said tree trunk, and said second semi-cylindrical annular array of light bulbs projects substantially parallel to said longitudinal axis of said tree trunk.

* * * * *